US010383424B2

(12) United States Patent
Kim

(10) Patent No.: US 10,383,424 B2
(45) Date of Patent: Aug. 20, 2019

(54) NAIL CLIPPER

(71) Applicant: THREE SEVEN CORPORATION, Cheonan (KR)

(72) Inventor: SangMug Kim, Cheonan (KR)

(73) Assignee: THREE SEVEN CORPORATION, Cheonan (KR)

( * ) Notice: Subject to any disclaimer, the term of this patent is extended or adjusted under 35 U.S.C. 154(b) by 204 days.

(21) Appl. No.: 15/525,073

(22) PCT Filed: Jul. 7, 2015

(86) PCT No.: PCT/KR2015/006978
§ 371 (c)(1),
(2) Date: May 8, 2017

(87) PCT Pub. No.: WO2016/093454
PCT Pub. Date: Jun. 16, 2016

(65) Prior Publication Data

US 2018/0279739 A1 Oct. 4, 2018

(30) Foreign Application Priority Data

Dec. 9, 2014 (KR) ..... 10-2014-0175815

(51) Int. Cl.
*A45D 29/02* (2006.01)
*A45D 29/04* (2006.01)

(52) U.S. Cl.
CPC ..... *A45D 29/02* (2013.01); *A45D 29/04* (2013.01); *A45D 2029/026* (2013.01)

(58) Field of Classification Search
CPC . A45D 29/02; A45D 29/023; A45D 2029/026
USPC ..... 30/26, 27, 28, 29; 132/75
See application file for complete search history.

(56) References Cited

U.S. PATENT DOCUMENTS 796,389 A * 8/1905 Wright ..... A45D 29/02 132/73
3,154,850 A * 11/1964 Okuno ..... A45D 29/023 132/73
4,117,591 A * 10/1978 Terry ..... A45D 29/023 30/124

(Continued)

FOREIGN PATENT DOCUMENTS

JP 2006-509611 A 3/2006
KR 20-0358516 Y1 8/2004

(Continued)

*Primary Examiner* — Jennifer B Swinney
(74) *Attorney, Agent, or Firm* — Gokalp Bayramoglu

(57) ABSTRACT

A nail clipper includes a cutting unit which includes an inner elastic plate which is bent such that a pair of cutting blades faces each other and the inner elastic plate has elastic restoring force, an outer elastic plate which is bent to surround an outer surface of the inner elastic plate and has elastic restoring force, and a pushing plate which has one end assembled to a support shaft disposed in inner and outer shaft holes penetratively formed in the inner and outer elastic plates and elastically deforms the inner and outer elastic plates by being pushed; a handle unit which includes a first main body which has an internal space into which the cutting unit is inserted and disposed, and a scattering prevention unit prevents a cut object cut by the cutting blades from scattering.

19 Claims, 9 Drawing Sheets

(56) References Cited

U.S. PATENT DOCUMENTS

| | | | | |
|---|---|---|---|---|
| 4,996,771 | A * | 3/1991 | Williams | A45D 29/023 132/75.5 |
| 2003/0010349 | A1* | 1/2003 | Rende | A45D 29/023 132/75 |
| 2006/0026839 | A1* | 2/2006 | Merheje | A45D 29/02 30/28 |
| 2008/0301946 | A1* | 12/2008 | Baek | A45D 29/023 30/28 |

FOREIGN PATENT DOCUMENTS

| | | | |
|---|---|---|---|
| KR | 10-2004-0088124 | A | 10/2004 |
| KR | 10-2011-0053531 | A | 5/2011 |
| KR | 10-2012-0113501 | A | 10/2012 |

* cited by examiner

NAIL CLIPPER

CROSS REFERENCE TO RELATED APPLICATIONS

This application is the national phase entry of International Application No. PCT/KR2015/006978, filed on Jul. 7, 2015, which is based upon and claims priority to Korean Patent Application No. 10-2014-0175815 (KR), filed on Dec. 9, 2014, the entire contents of which are incorporated herein by reference.

TECHNICAL FIELD

The present invention relates to a nail clipper, and more particularly, to a nail clipper capable of allowing a used blade structure to be conveniently changed and preventing a cut object produced when trimming a fingernail from scattering.

BACKGROUND

In general, a nail clipper is a tool for cutting a fingernail and a toenail of a human to an appropriate length, and the nail clipper is one of the essential sanitary tools which are indispensable in a modern life.

The fingernails and the toenails grow in human's lifetime, and the fingernails and the toenails which have grown to a certain length or longer cause a great inconvenience in daily life, and result in unsanitary feeling in appearance.

Therefore, the fingernail and the toenail need to be periodically treated for the purpose of personal hygiene, and to this end, the aforementioned nail clipper is required.

The nail clipper is a tool for trimming the fingernail or the toenail, and thus the nail clipper also needs to be hygienically managed. However, a number of persons use a single nail clipper, which causes very unhygienic problems.

In addition, in a case in which a number of persons use a single nail clipper in common in home or in a public place such as a beauty salon or a public bath, the nail clipper is not properly treated, which causes very unhygienic problems. To solve the problems, the nail clipper needs to be replaced with a new nail clipper, but there is a problem in that a large amount of costs is required to change the nail clipper.

Further, because the nail clippers having blade structures different in shape are used to meet an age of a user or the purpose of use, the user needs to purchase and use a plurality of nail clippers with blade structures having different shapes. However, in a case in which the plurality of nail clippers are used, there are problems in that it is difficult to manage the plurality of nail clippers, and when the user loses the plurality of nail clippers, the user needs to purchase the entire nail clippers again.

Meanwhile, when trimming the fingernail or the toenail by using the nail clipper, the fingernail or the toenail (hereinafter, a cut object), which is pressed and cut between the cutting blades of a main body, scatters rearward from the nail clipper and then outward in a non-directional manner even though the user carefully trims the fingernail or the toenail, and the user suffers from the inconvenience of having to pick up the cut objects dropped on the floor after using the nail clipper.

In addition, the nail clipper in the related art is provided with a main body which is held by a users hand, and includes two sheets of upper and lower plates having cutting blades, respectively, which face each other, and the upper and lower plates are made of a metallic material in order to form the cutting blades.

In this case, the upper and lower plates made of a metallic material need to be subjected to a cutting process and a pressing process, and then need to be joined together through a spot welding process, so that the upper and lower plates have elastic force and the cutting blades at the tips of the upper and lower plates face each other, and as a result, the manufacturing processes are complicated, and there is a limitation in reducing manufacturing costs because the usage amount of metallic materials is increased.

(Patent Literature 1) KR20-0358516 Y1

SUMMARY OF THE INVENTION

Technical Problem

Therefore, the present invention has been made in an effort to solve the aforementioned problems, and an object of the present invention is to provide a nail clipper which enables a reduction in manufacturing costs because the usage amount of metallic materials is reduced and an external appearance and structure is simplified, allows cut objects produced when using the nail clipper to be collected while preventing the cut objects from scattering outward, and allows a user to conveniently change and use a blade structure having cutting blades.

Technical problems to be solved by the present invention are not limited to the aforementioned technical problem, and other technical problems, which are not mentioned above, may be clearly understood from the following descriptions by those skilled in the art to which the present invention pertains.

Technical Solution

As a specific means for achieving the aforementioned object, the present invention provides a nail clipper including: a cutting unit which includes an inner elastic plate which is bent such that a pair of cutting blades faces each other and the inner elastic plate has elastic restoring force, an outer elastic plate which is bent to surround an outer surface of the inner elastic plate and has elastic restoring force, and a pushing plate which has one end assembled to a support shaft disposed in inner and outer shaft holes penetratively formed in the inner and outer elastic plates and elastically deforms the inner and outer elastic plates by being pushed, in which the cutting unit generates cutting force by the cutting blades that face each other; a handle unit which includes a first main body which has an internal space into which the cutting unit is inserted and disposed, and a second main body which extends outward by a predetermined length from the first main body, such that a user who pushes the pushing plate holds the handle unit; and a scattering prevention unit which includes a movable body which has a guide protrusion movably assembled to a guide path formed in the first main body, and prevents a cut object cut by the cutting blades from scattering.

Particularly, the inner elastic plate includes upper and lower plates which each have the cutting blade at one end thereof and the inner shaft hole penetratively formed therein, and a bending plate which connects the other end of the upper plate and the other end of the lower plate and is bent to generate elastic restoring force, and the outer elastic plate includes upper and lower plates which each have the outer shaft hole penetratively formed at one end thereof, and a bending plate which connects the other end of the upper plate and the other end of the lower plate and is bent to generate elastic restoring force.

More particularly, the support shaft is penetratively disposed in the inner shaft holes in the form of an oblong hole continuously extending along upper and lower plates and an elastic plate of the inner elastic plate, and a lower end of the support shaft, which is penetratively disposed in the outer shaft holes in the form of a circular hole penetratively formed in upper and lower plates of the outer elastic plate, is disposed to be caught by a catching hole penetratively formed in a bottom surface of the first main body.

More particularly, the movable body includes a catching protrusion which is interposed between the inner elastic plate and the outer elastic plate, and disposed in the guide path.

Particularly, the first main body includes a first bottom plate having a catching hole penetratively formed so that a lower end of the support shaft is disposed to be caught by the catching hole, and a pair of inner sidewalls which extends vertically at both left and right sides of the first bottom plate, and has a guide path to which the guide protrusion of the movable body is assembled to be movable by being guided by the guide path.

More particularly, the second main body includes a holder having an internal space that temporarily stores at least one auxiliary beauty tool.

More particularly, the second main body includes a cover member which covers an opened upper side of the holder and seals the holder.

More particularly, the holder includes a fixing hole which is formed to be opened so that the auxiliary beauty tool enters or exits through the fixing hole, and a coupling body coupled to one end of the auxiliary beauty tool is inserted and disposed through the fixing hole.

More particularly, the holder includes a first stopper which comes into contact with an outer surface of the auxiliary beauty tool temporarily stored in the internal space and generates fixing force.

More particularly, the cover member includes a second stopper which comes into contact with an outer surface of the auxiliary beauty tool temporarily stored in the internal space of the holder and generates fixing force.

Particularly, a partition wall is provided between the first main body and the second main body.

Particularly, the movable body includes a pair of outer sidewalls which extends vertically from both left and right sides of a second bottom plate, and has a guide protrusion which is assembled to the guide path of the first main body so as to be movable by being guided by the guide path.

Particularly, the second bottom plate is provided with a discharge recess which is recessed by a predetermined depth so as to form a passageway, through which a cut object is discharged, between the second bottom plate and the first main body.

Advantageous Effects

The present invention described above has the following effects.

(1) The movable body is disposed outside the first main body into which the cutting unit including the inner and outer elastic plates and the pushing plate is inserted and disposed, and as a result, it is possible to prevent the scattering of the cut object produced when a fingernail or a toenail is cut by the cutting blades of the inner elastic plate, and to conveniently collect the cut object, thereby preventing contamination of a peripheral environment which is caused by the cut object scattering in a non-directional manner, and preventing the inconvenience of collecting the cut object.

(2) The pair of upper and lower metallic plates assembled with the pushing plate is replaced with the inner and outer metallic plates bent in an approximately U shape, and as a result, it is possible to reduce the usage amount of the metallic material, simplify an external appearance and structure, and reduce the number of component assembly processes, thereby improving price competitiveness by reducing manufacturing costs.

(3) The blade structure may be conveniently changed to meet an age of a user or the purpose use by separating the inner elastic plate having the cutting blades used to cut a fingernail and a toenail by moving the inner elastic plate forward and outward relative to the outer elastic plate, and as a result, it is possible to easily perform a hygienic management, diversify the functions of the nail clipper by changing components, and reduce costs required for maintenance.

BRIEF DESCRIPTION OF THE DRAWINGS

FIG. 4 is a view illustrating a cutting unit applied to the nail clipper according to the exemplary embodiment of the present invention, in which

FIG. 7 is a view illustrating a state in which the nail clipper according to the exemplary embodiment of the present invention is used, in which

DETAILED DESCRIPTION OF THE INVENTION

Hereinafter, exemplary embodiments of the present invention will be described in detail with reference to the accompanying drawings so that those skilled in the technical field to which the present invention pertains may easily carry out the present invention.

Figure 1:
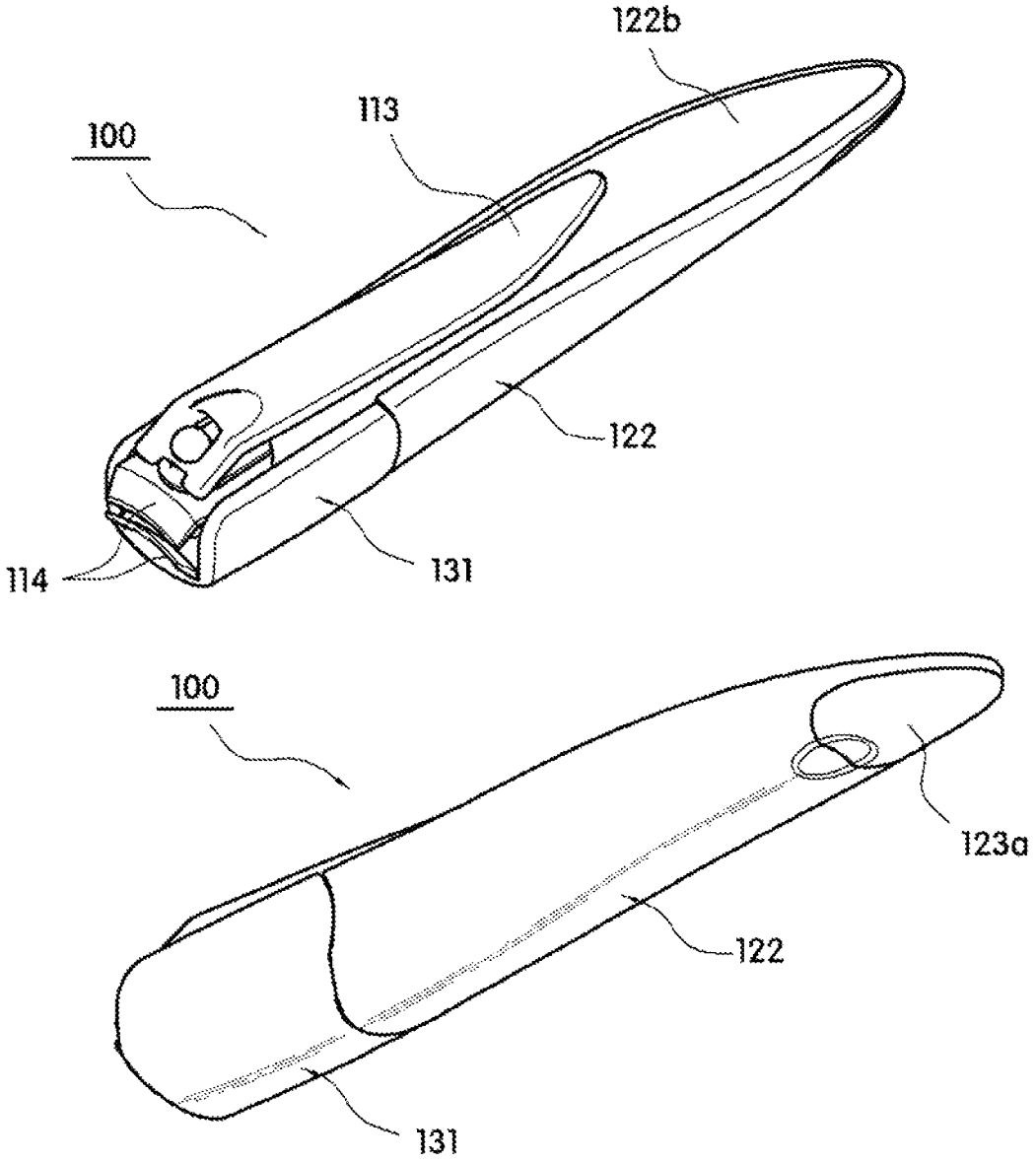
FIG. 1 is an overall perspective view illustrating a nail clipper according to an exemplary embodiment of the present invention.
Figure 2:
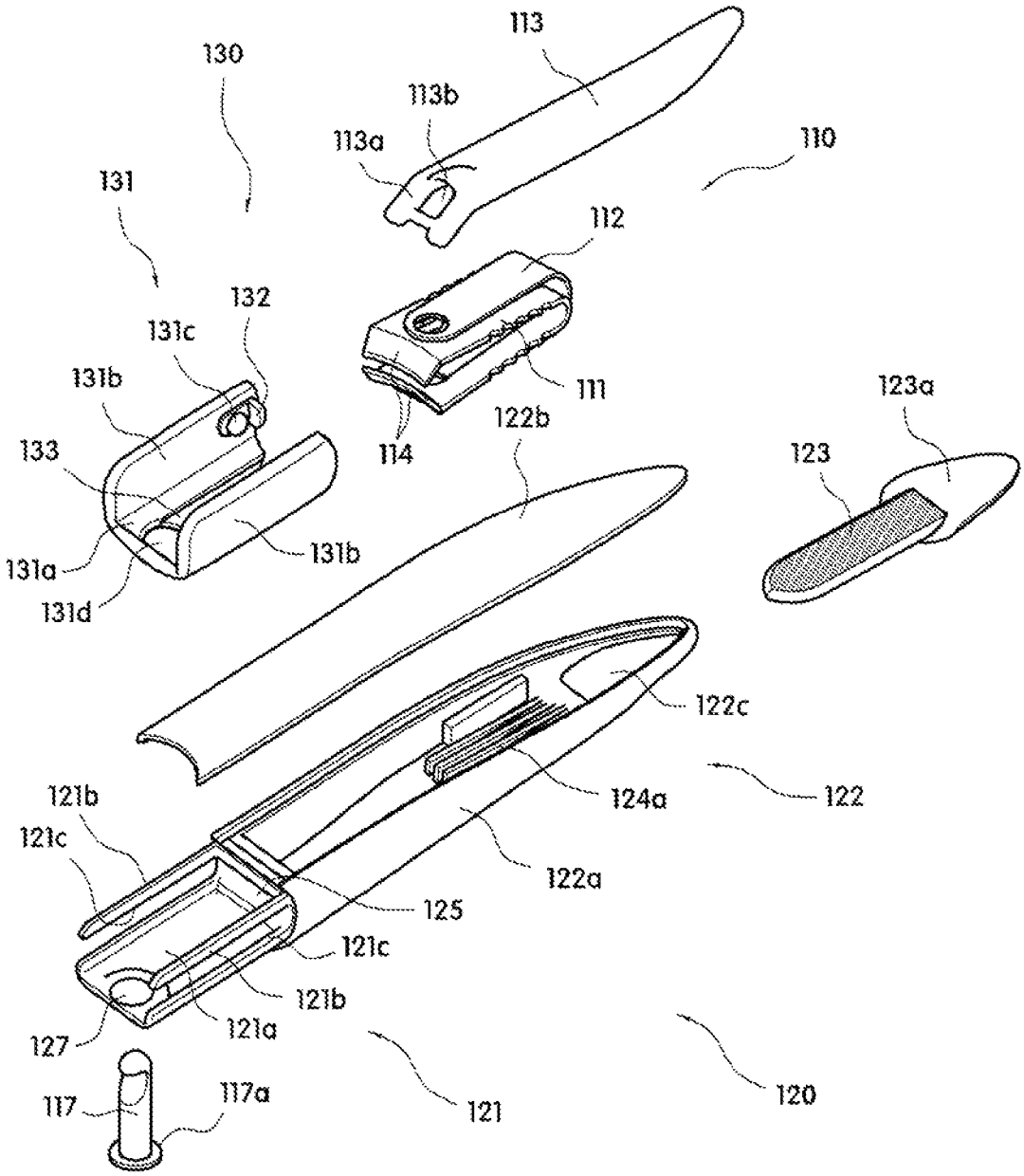
FIG. 2 is an exploded perspective view illustrating the nail clipper according to the exemplary embodiment of the present invention.
Figure 3:
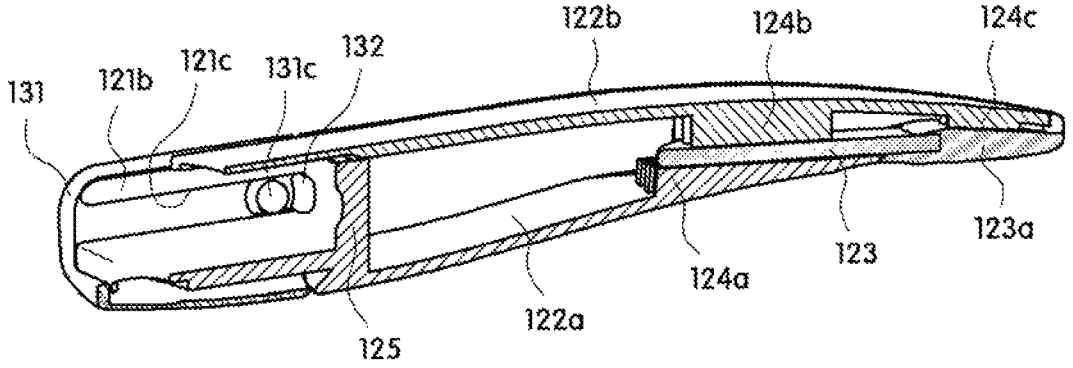
FIG. 3 is a cross-sectional perspective view illustrating a handle unit applied to the nail clipper according to the exemplary embodiment of the present invention.
Figure 4A:
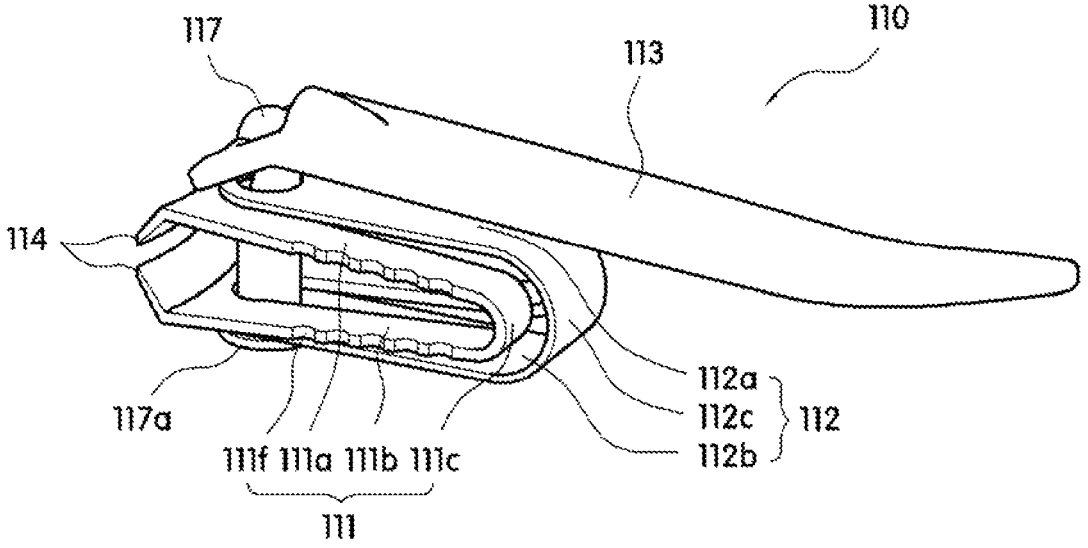
FIG. 4A is an assembled perspective view.
Figure 4B:
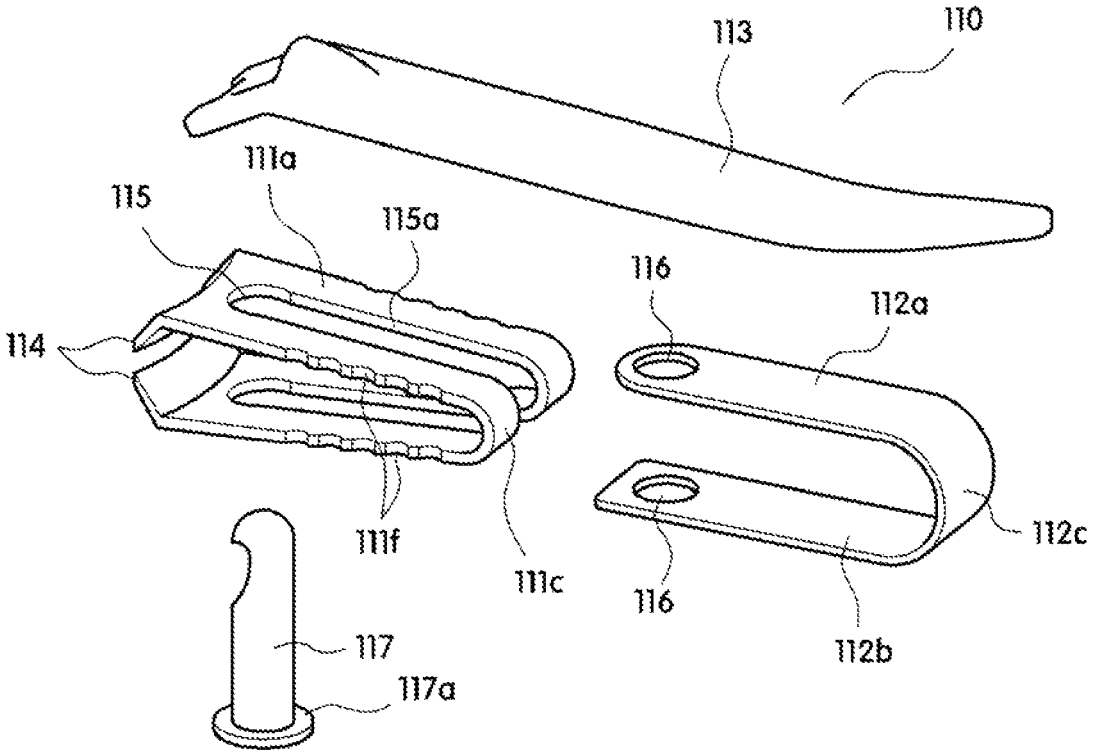
FIG. 4B is an exploded perspective view.
Figure 5:
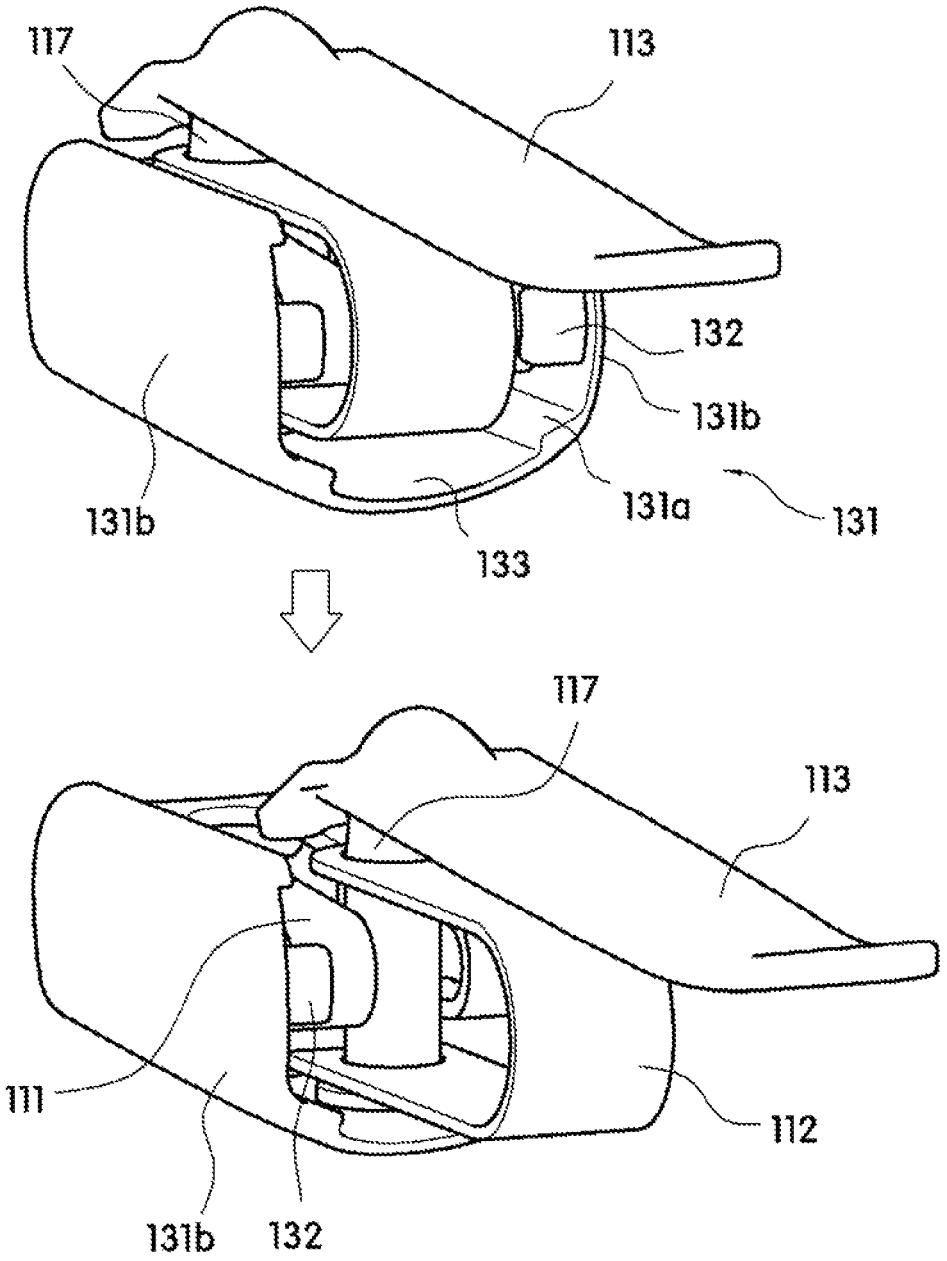
FIG. 5 is a view illustrating a state in which a movable body of a scattering prevention unit applied to the nail clipper according to the exemplary embodiment of the present invention is operated.
Figure 6A:
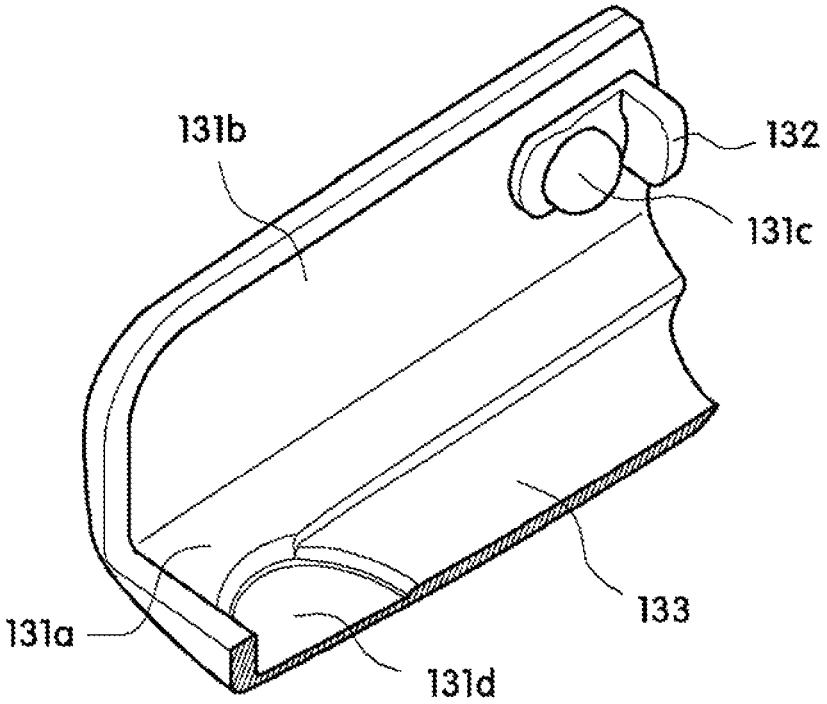
FIG. 6A is a cross-sectional perspective view of the movable body applied to the nail clipper according to the exemplary embodiment of the present invention.
Figure 6B:
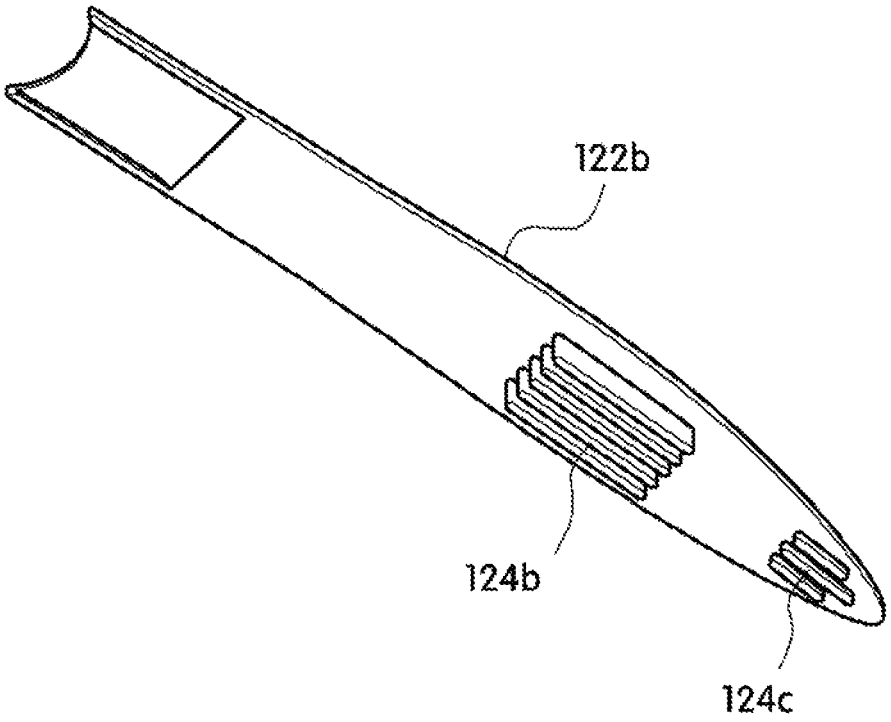
FIG. 6B is a perspective view illustrating a cover member applied to the nail clipper according to the exemplary embodiment of the present invention.
Figure 7A:
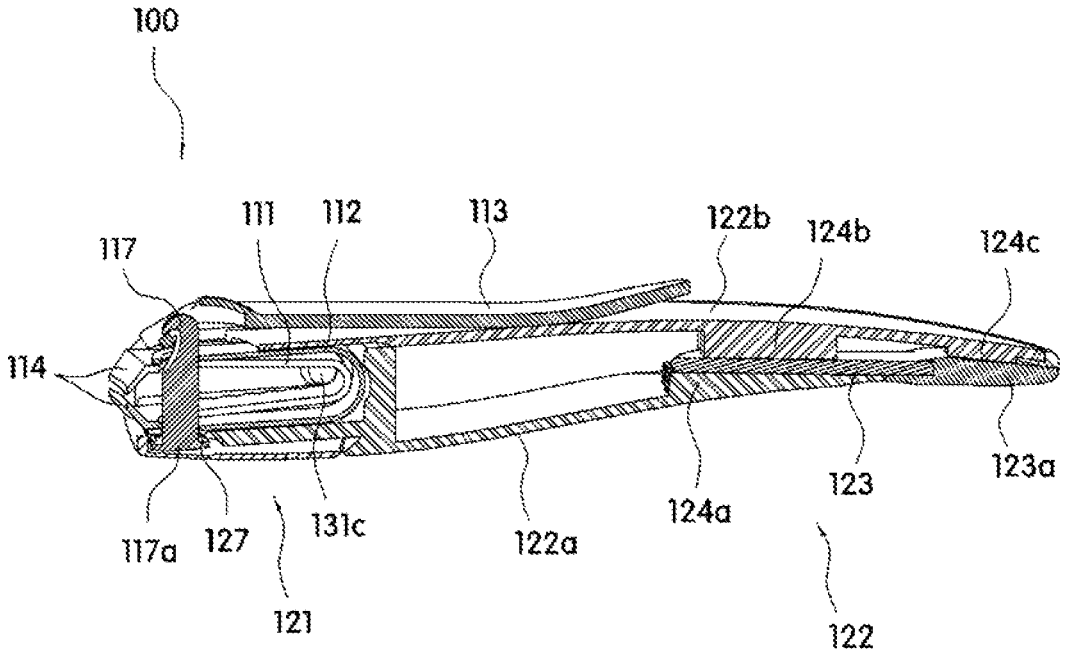
FIG. 7A is a cross-sectional perspective view illustrating a state in which the movable body is ready to prevent a cut object from scattering.
Figure 7B:
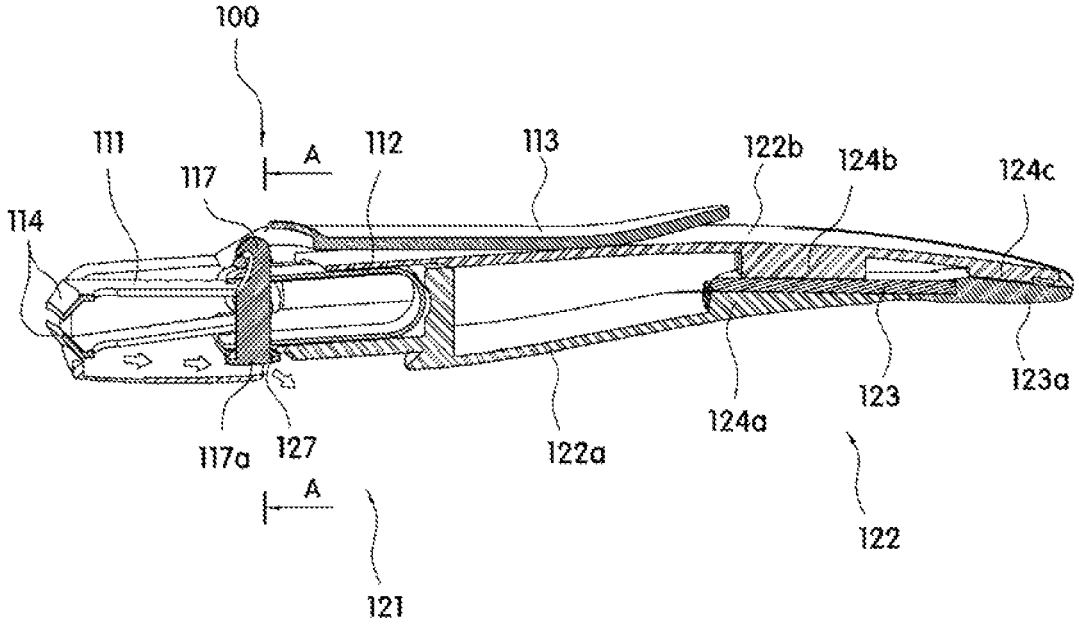
FIG. 7B is a cross-sectional perspective view illustrating a state in which the movable body is moved to discharge the cut object and to change an inner elastic plate.
Figure 8:
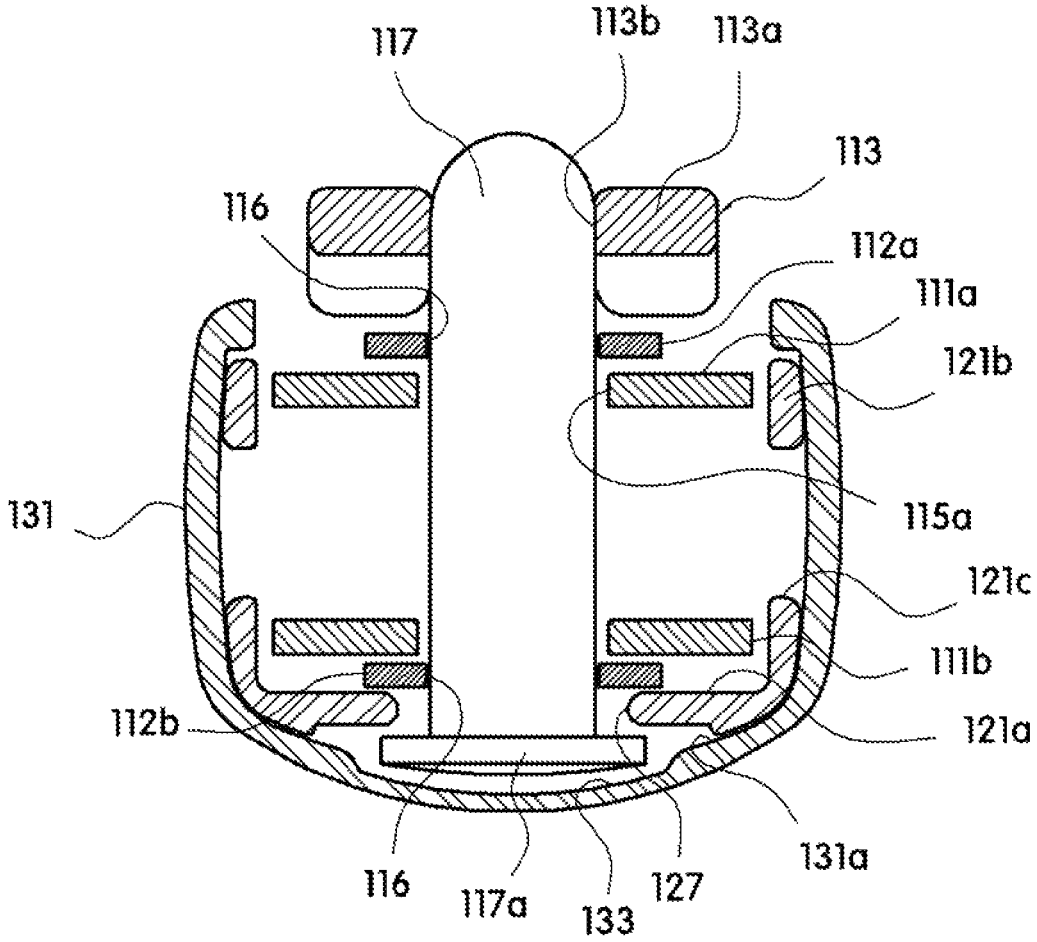
FIG. 8 is a longitudinal cross-sectional view illustrating a state in which a cut object is discharged from the nail clipper according to the exemplary embodiment of the present invention.

As illustrated in FIGS. 1 to 8, a nail clipper 100 according to an exemplary embodiment of the present invention includes a cutting unit 110, a handle unit 120, and a scattering prevention unit 130 in order to prevent a cut object from scattering outward when cutting a cut object such as a fingernail or a toenail, and to easily replace a blade structure having a cutting blade with a new blade structure.

The cutting unit 110 includes an inner elastic plate 111 which has cutting blades 114 which are provided to face each other and used to cut a part of a fingernail or a toenail which is an object to be cut and trimmed, and an outer elastic plate 112 which is disposed outside the inner elastic plate 111.

The inner elastic plate 111 may be configured as a bending type elastic plate which is bent such that the pair of cutting blades 114 faces each other to enable the cutting operation, and has elastic restoring force so that the bending type elastic plate returns back to the original state when external force is eliminated.

The outer elastic plate 112 may be configured as a bending type elastic plate which is bent to surround an outer surface of the inner elastic plate 111 and to have elastic restoring force so that the bending type elastic plate returns back to the original state when external force is eliminated.

Here, the inner elastic plate 111 may be made of a metallic material and made by bending a metallic plate, which has the cutting blades 114 formed at both ends thereof and has a predetermined length, so that the cutting blades face each other and the metallic plate has a roughly U shape, and the outer elastic plate 112 may be made of a metallic material and made by bending a metallic plate which has outer shaft holes 116 penetratively formed at both ends thereof and has a predetermined length, so that the outer shaft holes face each other and the metallic plate has a roughly U shape.

The metallic plate of the inner elastic plate 111 may have a relatively longer length than the metallic plate of the outer elastic plate 112.

The inner elastic plate 111 may include upper and lower plates 111*a* and 111*b* which each have the cutting blade 114 and an inner shaft hole 115 at one end thereof, and a bending plate 111*c* which integrally connects the other end of the upper plate and the other end of the lower plate and is bent to have elastic restoring force.

In addition, the outer elastic plate 112 may include upper and lower plates 112*a* and 112*b* which each have the outer shaft holes 116 penetratively formed at one end thereof, and a bending plate 112*c* which integrally connects the other end of the upper plate and the other end of the lower plate and is bent to have elastic restoring force.

Here, the bending plates 111*c* and 112*c*, which are provided in the inner and outer elastic plates 111 and 112, respectively, are illustrated and described as being integrally extended from the other end of the upper plate and the other end of the lower plate, but the present invention is not limited thereto, and the bending plates 111*c* and 112*c* may be configured as a separate bending plate which is detachably coupled to the other end of the upper plate and the other end of the lower plate.

The inner elastic plate 111 has the pair of inner shaft holes 115 penetratively formed to face each other, and the outer elastic plate 112 has the pair of outer shaft holes 116 penetratively formed to face each other so that the pair of outer shaft holes 116 are positioned along the same vertical axis while corresponding to the inner shaft holes.

A support shaft 117 having a predetermined length is inserted into the inner and outer shaft holes 115 and 116 and disposed vertically, and a part of a tip, that is, one end of a pushing plate 113 having a predetermined length is connected to an upper end of the support shaft 117 which is exposed to the outside through the upper outer shaft hole 116 of the outer elastic plate 112, such that the pushing plate 113 is assembled to enable a pushing operation at a rear end thereof based on the principle of leverage.

A catching projection 117*a*, which is caught by a catching hole 127 penetratively formed in a first bottom plate 121*a* of a first main body portion 121 to be described below so that the catching projection 117*a* is not separated and withdrawn from the catching hole 127, is provided at a lower end of the support shaft 117 which is exposed to the outside through the lower outer shaft hole 116 of the outer elastic plate 112.

Therefore, the inner and outer elastic plates 111 and 112 may be restricted by the pushing plate 113 of which one end is rotatably assembled to the upper end of the support shaft, and by the catching projection 117*a* provided at the lower end of the support shaft.

A configuration in which a connecting piece 113*a*, which is bent at a predetermined angle, is provided at one end of the pushing plate 113, and a connecting hole 113*b*, which is caught by and connected to a catching groove recessed at an upper end of the support shaft 117, is penetratively formed in the connecting piece 113*a* so as to enable the leverage operation of the pushing plate is illustrated and described, but the present invention is not limited thereto, and in a case in which a pin hole is penetratively formed at the upper end of the support shaft, a connecting hole having a pin member assembled to correspond to the pin hole may be penetratively formed.

The handle unit 120 includes the first main body 121 which is coupled to the cutting unit 110 so that a user, who pushes the pushing plate 113 of the cutting unit 110, may conveniently hold the handle unit 120, and a second main body 122 which extends outward by a predetermined length from the first main body 121.

The first main body 121 has an inlet and an internal space opened at an upper side thereof so that the inner and outer elastic plates 111 and 112 of the cutting unit 110 are inserted and disposed in the internal space, and the first main body 121 includes the first bottom plate 121*a* which has the catching hole 127 penetratively formed so that the lower end of the support shaft 117 is disposed to be caught by the catching hole 127, and a pair of inner sidewalls 121*b* which is provided at left and right sides, extends roughly vertically from both left and right sides of the first bottom plate 121*a*, and has guide paths 121*c* so that guide protrusions 131*c* formed on a movable body 131 of the scattering prevention unit 130 are moved by being guided by the guide paths 121*c*.

Here, the guide path 121*c*, in which the guide protrusion 131*c* is disposed and which guides the horizontal reciprocal movement of the movable body, is illustrated and described as being provided in the form of an oblong hole opened at one end thereof, but the present invention is not limited thereto, and the guide path 121*c* may be provided in the form of an oblong hole closed at both ends thereof, or may be provided in the form of a guide groove recessed in an inner surface of the inner sidewall 121*b*.

The second main body 122 includes a holder 122*a* having a cover member 122*b* that covers the opened upper side of the internal space and seals the internal space, and in the second main body 122, at least one auxiliary beauty tool 123 such as a rasp and an ear pick may be temporarily disposed and stored in an internal space of the holder.

To allow the user to conveniently withdraw the auxiliary beauty tool outward and then use the auxiliary beauty tool, a fixing hole 122*c* is formed to be opened in an outer surface of the holder 122*a* so as to communicate with the internal space, and the fixing hole 122*c* functions as a passageway through which the auxiliary beauty tool 123 enters and exits, and a coupling body 123*a* coupled to one end of the auxiliary beauty tool is inserted and disposed into the fixing hole 122*c*, thereby preventing the auxiliary beauty tool temporarily stored in the internal space from being lost.

Here, to more safely and temporarily store the auxiliary beauty tool 123, which is inserted and disposed into the internal space of the holder 122*a*, without concern about losing the auxiliary beauty tool 123, a first stopper 124*a*, which comes into contact with an outer surface of the auxiliary beauty tool 123 inserted through the fixing hole 122*c* and generates fixing force, may be provided in the internal space of the holder 122*a*.

The first stopper 124*a* extends from an inner surface of the holder 124, and second stoppers 124*b* and 124*c*, which come into contact with an outer surface of the auxiliary beauty tool 123 or the coupling body 123*a* coupled to the auxiliary beauty tool 123 and generate fixing force, may also be provided on an inner surface of the cover member 122*b* assembled to cover the opened outer surface of the holder 122*a*.

In addition, the first main body 121 and the second main body 122 may be divided by a partition wall 125 so that the internal space into which the cutting unit is inserted and disposed and the internal space in which the auxiliary beauty tool is temporarily stored may be formed independently of each other, and the first and second main bodies 121 and 122 may be configured as a structure made of a resin material.

The scattering prevention unit 130 includes the movable body 131 which has the guide protrusions 131*c* slidably assembled to correspond to the guide paths 121*c* formed in the inner sidewalls 121*b* of the first main body 121 such that the movable body 131 is slidably assembled to the first main body 121.

The movable body 131 has a second bottom plate 131*a* corresponding to the first bottom plate 121*a* of the first main body 121, and includes a pair of outer sidewalls 131*b* which is disposed at left and right sides, extends by a predetermined height vertically from both left and right sides of the second bottom plate, and faces and corresponds to the inner sidewalls 121*b*.

Therefore, when the movable body 131 is disposed to overlap the first main body 121, a cut object, which scatters into the inner elastic plate when the object is cut by the cutting blades 114, collides with the outer sidewalls 131*b*, thereby basically inhibiting and preventing the cut object from scattering outward from the cutting unit and the first main body At least one guide protrusion 131*c*, which protrudes to be assembled to correspond to the guide path 121*c* formed in the inner sidewall 121*b* of the first main body so that the movement of the guide protrusion 131*c* is guided by the guide path 121*c*, is provided on an inner surface of the outer sidewall 131*b*.

Further, the movable body 131 has at least one catching protrusion 132 which is disposed in the guide path 121*c* of the first main body and interposed between the outer elastic plate 112 and the inner elastic plate 111 in order to conveniently separate the inner elastic plate 111 having the cutting blades from the outer elastic plate 112 restricted by the support shaft.

The catching protrusion 132 may be disposed between the bending plate 111*c*, which is a bent portion of the inner elastic plate 111, and the bending plate 112*c* which is a bent portion of the outer elastic plate 112.

Therefore, when the movable body 131, which is disposed to overlap the first main body 121, moves forward, the inner elastic plate 111, which is interfered with the catching protrusion when the movable body 131 moves forward by the engagement between the guide path and the guide protrusion or between the guide path and the catching protrusion, is withdrawn outward so as to be exposed to the outside from the first main body 121.

That is, the inner shaft holes 115 of the inner elastic plate 111 into which the support shaft 117 is penetratively disposed are provided in the form of an oblong hole continuously extending along the upper and lower plates 111*a* and 111*b* and the elastic plate 111*c*, the outer shaft holes 116 of the outer elastic plate 112 into which the support shaft 117 is penetratively disposed are provided in the form of a circular hole penetratively formed in the upper and lower plates 112*a* and 112*b*, and the lower end of the support shaft 117 is restricted by being disposed to be caught by the catching hole penetratively formed in the bottom surface of the first main body, and as a result, with respect to the outer elastic plate 112 fixed in position by being restricted by the support shaft 117, only the inner elastic plate 111, which is interfered with the catching protrusion 132 of the movable body 131, is moved forward together with the movable body so that the inner elastic plate 111 is exposed to the outside from the first main body and the outer elastic plate, or the inner elastic plate 111 may be completely separated and withdrawn so that the inner elastic plate 11I may be replaced with a new inner elastic plate.

In this case, serrated portions 111*f* may be formed at both outer rims of the upper and lower plates 111*a* and 111*b* of the inner elastic plate 111 so as to reduce frictional resistance by reducing a contact area with the inner sidewalls 121*b* of the first main body when the inner elastic plate 111 moves forward and returns backward together with the movable body.

Further, a discharge recess 133, which is recessed by a predetermined depth, is provided in the second bottom plate 131*a* of the movable body 131 so as to form a discharge passageway between the second bottom plate 131*a* and the first bottom plate of the first main body 121, such that when the movable body moves forward, the cut objects collected and remaining between the upper and lower plates of the inner elastic plate are dropped downward, and then may be discharged to the outside through the discharge passageway formed by the discharge recess 133.

In addition, an arrangement groove 131*d* may be recessed in the second bottom plate 131*a* so that the lower end of the support shaft is disposed in the arrangement groove 131*d*.

The present invention, which has been described above, is not limited by the aforementioned exemplary embodiment and the accompanying drawings, and it is obvious to those skilled in the art to which the present invention pertains that various substitutions, modifications and alterations may be made without departing from the technical spirit of the present invention.

What is claimed is:

1. A nail clipper comprising:

a cutting unit includes an inner elastic plate bent such that a pair of cutting blades face each other, an outer elastic plate bent to partially surround an outer surface of the inner elastic plate, and a pushing plate having one end assembled to a support shaft disposed in inner and outer shaft holes formed in the inner and outer elastic plates, a force exerted on the pushing plate moves the pair of cutting blades and the outer plate relative toward one another generating a cutting force;

a handle unit includes a first main body having an internal space, wherein the cutting unit is inserted and disposed into the internal space, and a second main body extending outward by a predetermined length from the first main body; and a scattering prevention unit includes a movable body having a guide protrusion engaged and moveable within a guide channel formed in the first main body, to prevent an object cut by the cutting blades from scattering.

2. The nail clipper of claim 1, wherein the inner elastic plate includes upper and lower plates each having one of the pair of cutting blades at one end thereof and the inner shaft hole formed therein, and a bending plate connects an other end of the upper plate and an other end of the lower plate, and the bending plate having an elastic restoring force, and the outer elastic plate includes upper and lower plates each having the outer shaft hole formed at one end thereof.

3. The nail clipper of claim 2, wherein the second main body includes a holder having an internal space that temporarily stores at least one auxiliary beauty tool.

4. The nail clipper of claim 1, wherein the inner shaft hole is an oblong continuous hole extending along the upper plate, the lower plate and the bending plate of the inner elastic plate, the support shaft is disposed in the inner shaft hole, and the outer shaft holes are circular holes formed in the upper and lower plates of the outer elastic plate, and a portion of a lower end of the support shaft is disposed in the outer shaft holes and the portion is disposed in a catching hole formed in a bottom surface of the first main body.

5. The nail clipper of claim 4, wherein the second main body includes a holder having an internal space that temporarily stores at least one auxiliary beauty tool.

6. The nail clipper of claim 1, wherein the movable body includes a catching protrusion interposed between the inner elastic plate and the outer elastic plate, and disposed in the guide channel.

7. The nail clipper of claim 6, wherein the second main body includes a holder having an internal space that temporarily stores at least one auxiliary beauty tool.

8. The nail clipper of claim 1, wherein the first main body includes a first bottom plate having a catching hole configured to hold a lower end of the support shaft, and a pair of inner sidewalls extend vertically from a left side and a right side of the first bottom plate, and the guide channel is disposed on the pair of inner side walls.

9. The nail clipper of claim 8, wherein the second main body includes a holder having an internal space that temporarily stores at least one auxiliary beauty tool.

10. The nail clipper of claim 1, wherein the movable body includes outer sidewalls extending vertically from both left and right sides of a second bottom plate, and the guide protrusion is disposed on the outer sidewalls.

11. The nail clipper of claim 10, wherein the second main body includes a holder having an internal space that temporarily stores at least one auxiliary beauty tool.

12. The nail clipper of claim 10, wherein the second bottom plate is provided with a discharge recess having a predetermined depth to form a passageway between the second bottom plate and the first main body.

13. The nail clipper of claim 12, wherein the second main body includes a holder having an internal space that temporarily stores at least one auxiliary beauty tool.

14. The nail clipper of claim 1, wherein the second main body includes a holder having an internal space that temporarily stores at least one auxiliary beauty tool.

15. The nail clipper of claim 14, wherein the second main body includes a cover member covering an opened upper side of the holder.

16. The nail clipper of claim 15, wherein the cover member includes a second stopper contacting an outer surface of the auxiliary beauty tool temporarily stored in the internal space of the holder and is configured to generate a fixing force.

17. The nail clipper of claim 14, wherein the holder includes a fixing hole, the auxiliary beauty tool is configured to enter or exit through the fixing hole, and a coupling body coupled to one end of the auxiliary beauty tool is inserted and disposed through the fixing hole.

18. The nail clipper of claim 14, wherein the holder includes a first stopper, the first stopper contacts an outer surface of the auxiliary beauty tool temporarily stored in the internal space and is configured to generate a fixing force.

19. The nail clipper of claim 1, wherein a partition wall is provided between the first main body and the second main body.

* * * * *